US007111342B2

(12) United States Patent
Owens, Jr. et al.

(10) Patent No.: US 7,111,342 B2
(45) Date of Patent: Sep. 26, 2006

(54) INTERIOR TREATMENTS AND FURNITURE OF FIBROUS FELT CONSTRUCTION

(75) Inventors: Jerry W. Owens, Jr., Boiling Springs, SC (US); Joseph C. Moon, Greer, SC (US); Susan K. Crow, Simpsonville, SC (US)

(73) Assignee: The Felters Group, Roebuck, SC (US)

( * ) Notice: Subject to any disclaimer, the term of this patent is extended or adjusted under 35 U.S.C. 154(b) by 165 days.

(21) Appl. No.: 10/367,634

(22) Filed: Feb. 14, 2003

(65) Prior Publication Data

US 2004/0035534 A1 Feb. 26, 2004

Related U.S. Application Data

(60) Provisional application No. 60/436,838, filed on Dec. 27, 2002, provisional application No. 60/405,983, filed on Aug. 26, 2002.

(51) Int. Cl.
*A47C 19/00* (2006.01)
*D04H 3/00* (2006.01)

(52) U.S. Cl. ..... 5/280; 5/53.1; 442/361; 442/402

(58) Field of Classification Search ..... 442/361, 442/264.409; 5/53.1, 280, 907, 952
See application file for complete search history.

(56) References Cited

U.S. PATENT DOCUMENTS

| | | | | |
|---|---|---|---|---|
| 2,612,462 | A | 9/1952 | Zettel | |
| 2,695,855 | A | 11/1954 | Stephens | 154/54 |
| 3,654,019 | A | 4/1972 | Cusick | 156/285 |
| 3,717,887 | A * | 2/1973 | Thomas | 5/280 |
| 3,736,603 | A * | 6/1973 | Rothman | 5/53.1 |
| 4,205,113 | A | 5/1980 | Hermansson et al. | 428/286 |
| 4,324,831 | A | 4/1982 | Parrini et al. | 428/288 |
| 4,333,786 | A | 6/1982 | Civardi et al. | 156/306.6 |
| 4,481,247 | A | 11/1984 | Tesch et al. | 428/234 |
| 4,581,272 | A | 4/1986 | Walters et al. | 428/88 |
| 4,625,983 | A | 12/1986 | Tye | 280/154.5 |
| 4,840,832 | A * | 6/1989 | Weinle et al. | 428/156 |
| 4,869,950 | A * | 9/1989 | Elsen et al. | 428/198 |
| 4,998,773 | A * | 3/1991 | Pesce | 297/451.4 |
| 5,149,920 | A | 9/1992 | Meeker et al. | 181/290 |
| 5,272,000 | A | 12/1993 | Chenoweth et al. | 428/283 |
| 5,518,806 | A | 5/1996 | Eder et al. | 428/218 |
| 6,008,149 | A * | 12/1999 | Copperwheat | 442/381 |
| 6,125,906 | A | 10/2000 | Kotin | 160/236 |
| 6,582,639 | B1 * | 6/2003 | Nellis | 264/119 |
| 6,658,677 | B1 * | 12/2003 | Paul | 5/280 |

* cited by examiner

*Primary Examiner*—Michael Trettel
(74) *Attorney, Agent, or Firm*—J.M. Robertson Intellectual Prop. LLC

(57) ABSTRACT

Interior design structures and lightweight furniture formed from a felted fibrous material such as needle punched felt as the material of construction in replacement for wood. The felted fibrous material is adapted to provide adequate strength to permit construction of three dimensional structures by use of standard joining techniques such as screws, nails, glue and the like. At the same time, the nature of the felted fibrous material affords the opportunity to bend and shape the material thereby allowing additional freedom in construction and use.

18 Claims, 9 Drawing Sheets

INTERIOR TREATMENTS AND FURNITURE OF FIBROUS FELT CONSTRUCTION

CROSS-REFERENCE TO RELATED APPLICATIONS

This application claims priority from prior filed provisional applications No. 60/405,983 having a filing date of Aug. 26, 2002 and 60/436,838 having a filing date of Dec. 27, 2002 both of which are incorporated by reference in their entirety as if fully set forth herein.

TECHNICAL FIELD

The present invention relates generally to interior design structures such as cornices, lambrequins, arched window treatments, bay window treatments, bed headboards and corona treatments, screens, as well as to lightweight furniture articles. More particularly, the present invention relates to such structures formed from felted fibrous materials having a controlled degree of flexibility while maintaining substantial stability and strength. Such structures may be used in residential, commercial or hotel environments.

BACKGROUND OF THE INVENTION

Interior design structures such as furniture, cornices, lambrequins, headboards, corona treatments and screens are well known. Typically in the past such structures have been formed from board stock materials such as wood or the like with segments of such material being cut to predefined shapes and thereafter being nailed, stapled or glued together to yield a desired construction. While such materials have been useful, they have faced limitations due to their relatively high weight as well as their inability to be easily bent to different geometries.

SUMMARY OF THE INVENTION

This invention provides advantages and alternatives over the prior art by providing interior design structures and lightweight furniture formed from a felted fibrous material such as needle punched felt as the material of construction in replacement for wood. The felted fibrous material is adapted to provide adequate strength to permit construction of three dimensional structures by use of standard joining techniques such as screws, nails, glue and the like. At the same time, the nature of the felted fibrous material affords the opportunity to bend and shape the material thereby allowing additional freedom in construction and use.

BRIEF DESCRIPTION OF THE DRAWINGS

The present invention will now be described by way of example only, with reference to the accompanying drawings which constitute a portion of the specification herein and in which.

While the present invention has been illustrated and generally described above and will hereinafter be described in conjunction with certain potentially preferred embodiments, procedures, and practices, it is to be understood that in no case is the invention to be limited to such illustrated and described embodiments, procedures, and practices. On the contrary, it is intended that the present invention shall extend to all alternatives, modifications, and equivalents as may embrace the principles of the present invention within the true scope and spirit thereof

DESCRIPTION OF THE PREFERRED EMBODIMENT

Figure 1:
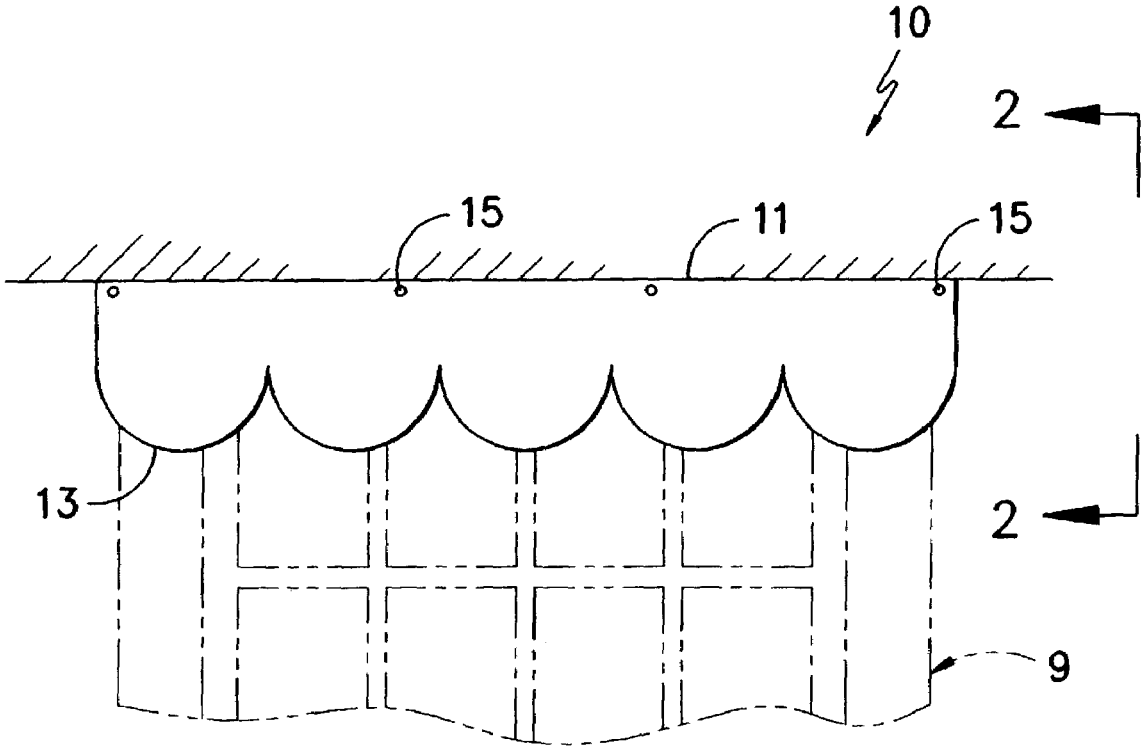
FIG. 1 is a view of the face of an exemplary box-like window cornice structure.
Figure 2:
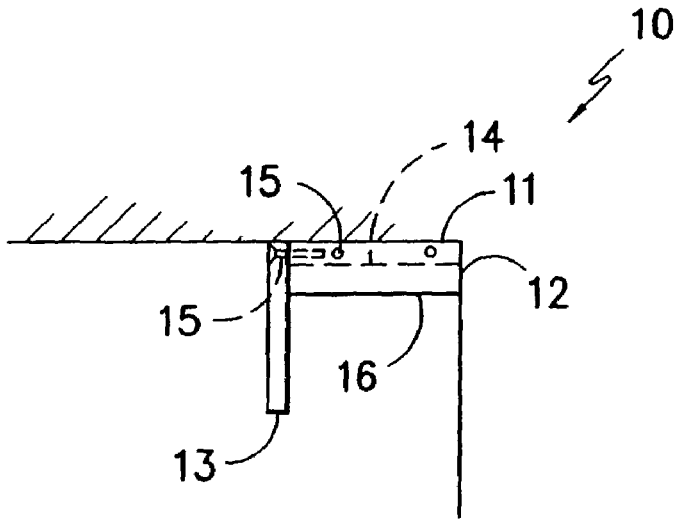
FIG. 2 is a view taken along line 2—2 in FIG. 1.

Reference will now be made to the drawings, wherein, to the extent possible, like reference numerals are utilized to designate like components throughout the various views. In FIGS. 1 and 2 there is illustrated an exemplary window cornice 10 for disposition in overhanging relation to a window designated generally as 9. As illustrated, the cornice is of a substantially open bottom box-like construction so as to hang below a ceiling 11 and away from a wall 12. As will be appreciated, while the upper surface of the cornice 10 is illustrated as being in abutting relation to the ceiling 11, it may likewise be disposed at positions substantially below the ceiling 11 if desired.

In the exemplary construction, the cornice 10 includes a face panel 13 of felted material as will be described further hereinafter affixed to the front edge of a top board 14 of felted material by fastening elements 15 such as screws, nails or the like. If desired, lateral sideboards 16 of felted material extend away from the face panel towards the wall 12. The sideboards 16 may be affixed to the sides of the top board 14 by fastening elements 15. Thus, upon construction, the cornice defines a relatively shallow box-like structure. In the event that no sideboards are utilized, a so called "valence" construction is obtained. A decorative fabric cover may be affixed across the surface of the cornice or valence by gluing, stapling or the like.

Figure 3:
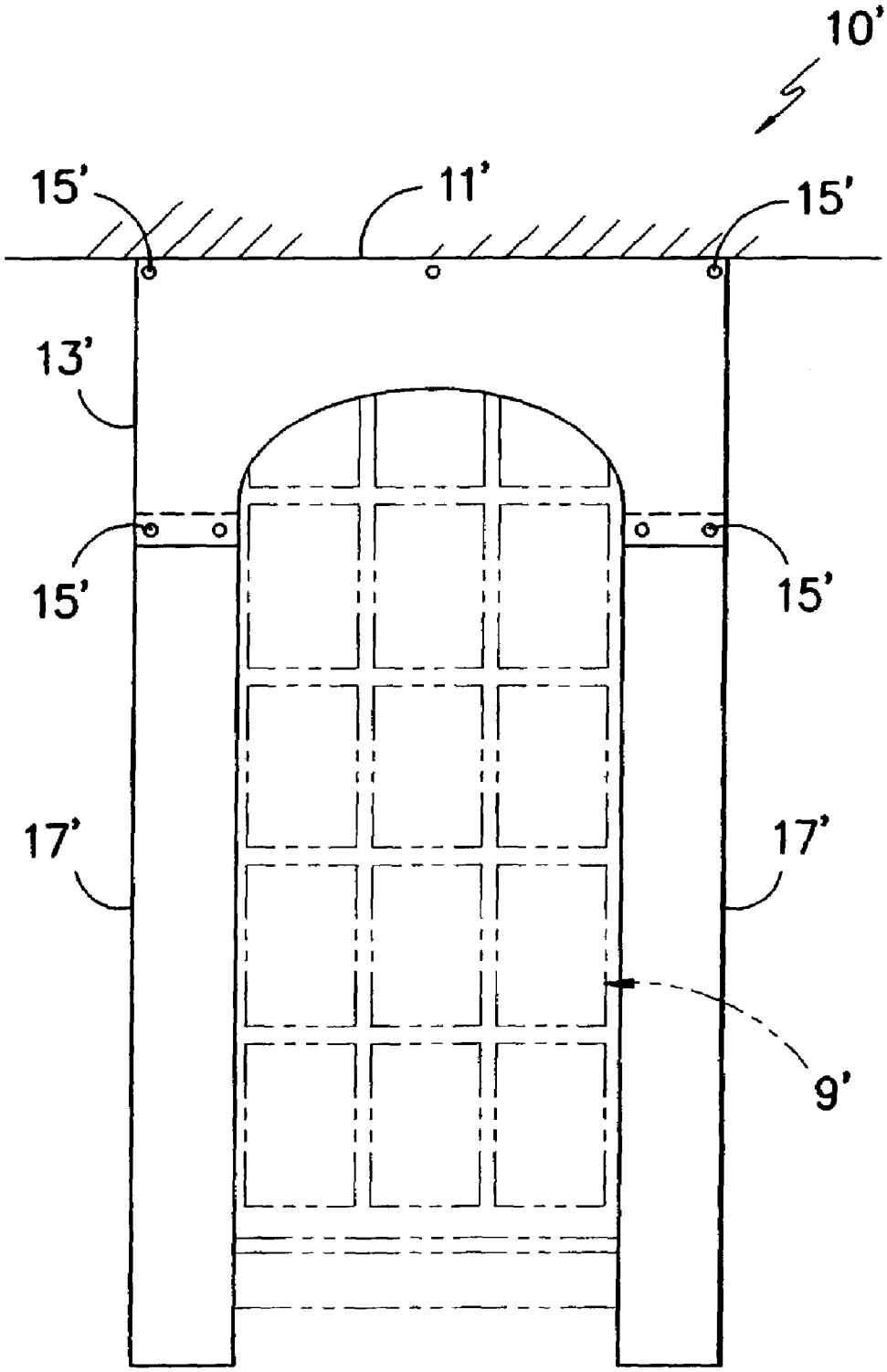
FIG. 3 is a face view of an exemplary lambrequin window treatment.

In FIG. 3, a variant of the invention in the form of a lambrequin 10' is illustrated wherein elements previously described in relation to FIG. 2 are designated by corresponding reference numerals with a prime. As illustrated, in this embodiment, the face panel 13' includes a pair of downwardly projecting elongate legs 17' which extend along either side of the window 9' In all other respects the structure is of a form as described in relation to FIG. 2 with side boards projecting away from the face towards a backing wall such that the labrequin 10' defines a substantially three dimensional arch structure around the window 9'.

Figure 4:
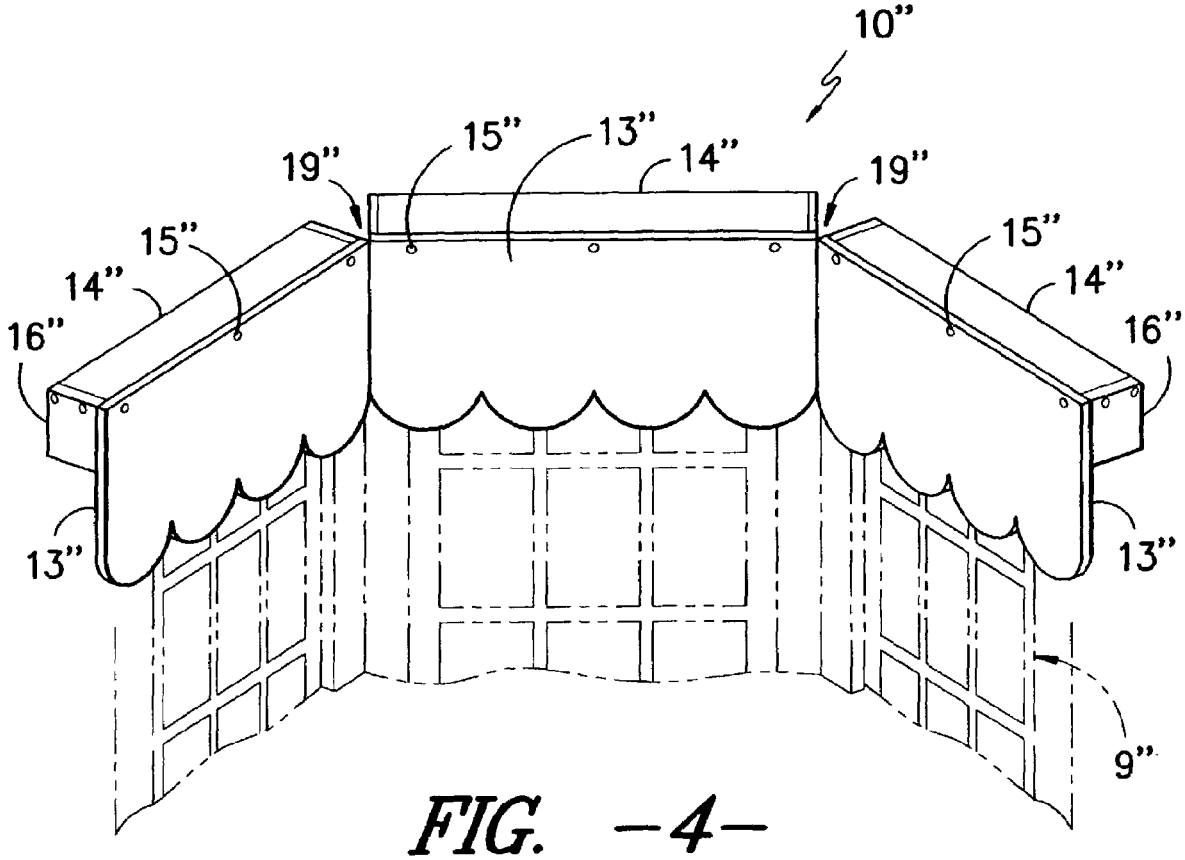
FIG. 4 is an elevated perspective view of an exemplary cornice construction for a bay window cornice structure.

Still another embodiment of a window cornice structure 10" is illustrated in FIG. 4 wherein elements previously described in relation to FIG. 2 are designated by corresponding reference numerals with a double prime. In this construction the fibrous felt material is subjected to a partial selective depth scoring so as to form a pattern of living hinges 19" between contiguous face panel portions 13". Due to the felted construction of the material forming the face panel portions 13" the structure may be bent along the living hinges so as to take on a substantially concave geometry. As will be appreciated, such a construction may be particularly useful for decorative placement in concave relation around the top of a bay window. Moreover, due to the flexibility imparted by the living hinges 19", the structure may be readily adapted to various window depths.

Figure 5:
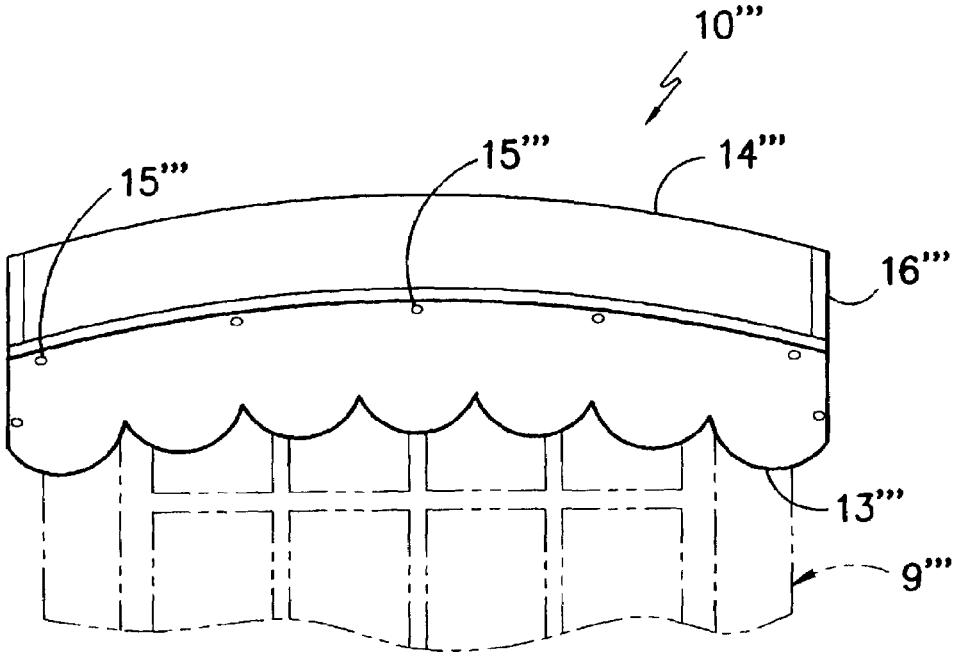
FIG. 5 is an elevated perspective view of an arched cornice for disposition across the top of an arched window.

Still another embodiment in the form of a window top treatment 10''' is illustrated in FIG. 5 in which elements corresponding to those previously described are designated by like reference numerals with a triple prime. As illustrated, in this construction the fibrous felt material is in the form of an arched top board 14''' which may be placed over the top of an arched window 9'''. A substantially planar face panel 13''' is attached by fastening elements 15''' such as screws, nails, adhesive or the like to an outwardly projecting edge of the top board 14''' so as to yield a three dimensional arched structure. Of course, in each of the embodiments illustrated in FIGS. 3–5, it is contemplated that a decorative covering fabric may be glued, stapled or otherwise attached to the outer surface of the structure.

Figure 6:
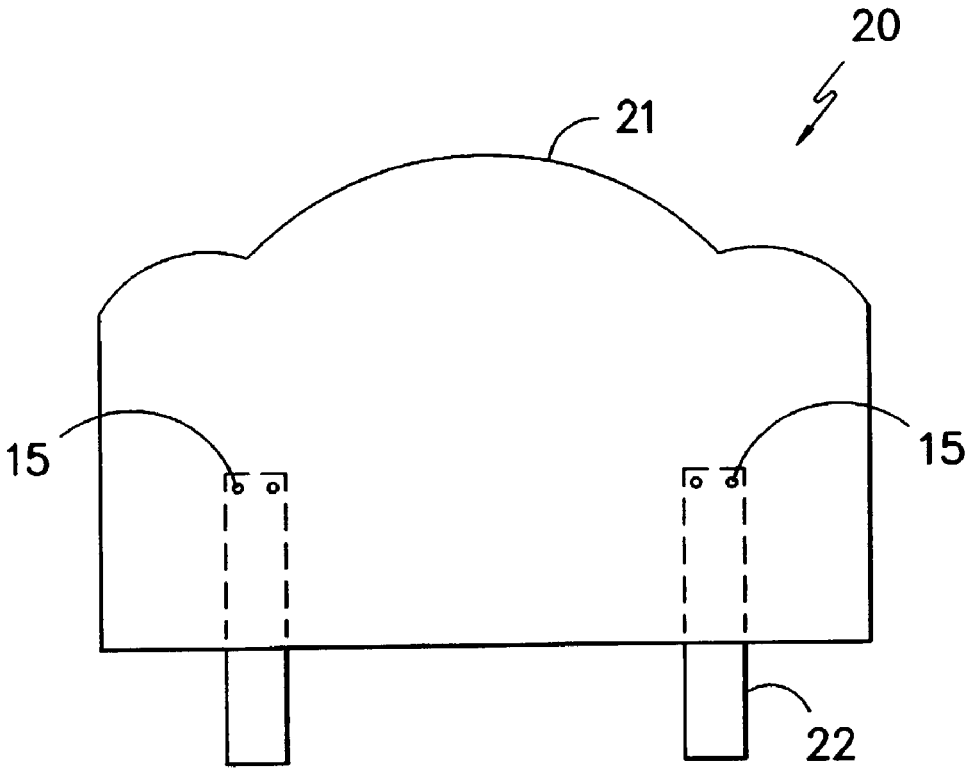
FIG. 6 is a face view of an exemplary bed headboard.

The structural stability of the felted fibrous material utilized also permits the formation of other interior items for subsequent covering with decorative fabric. By way of example only, in FIG. 6, there is illustrated an exemplary bed headboard 20 including a body portion 21 formed of felted fibrous material and optional mounting posts 22 which may also be constructed of felted fibrous material. As illustrated, the mounting posts 22 may be affixed to the body portion 21 by fastening elements 15 such as nails, screws, adhesive and the like as will be well known to those of skill in the art. Of course it is contemplated that a decorative covering fabric may be glued, stapled or otherwise attached to the outer surface of the headboard 20.

Figure 7:
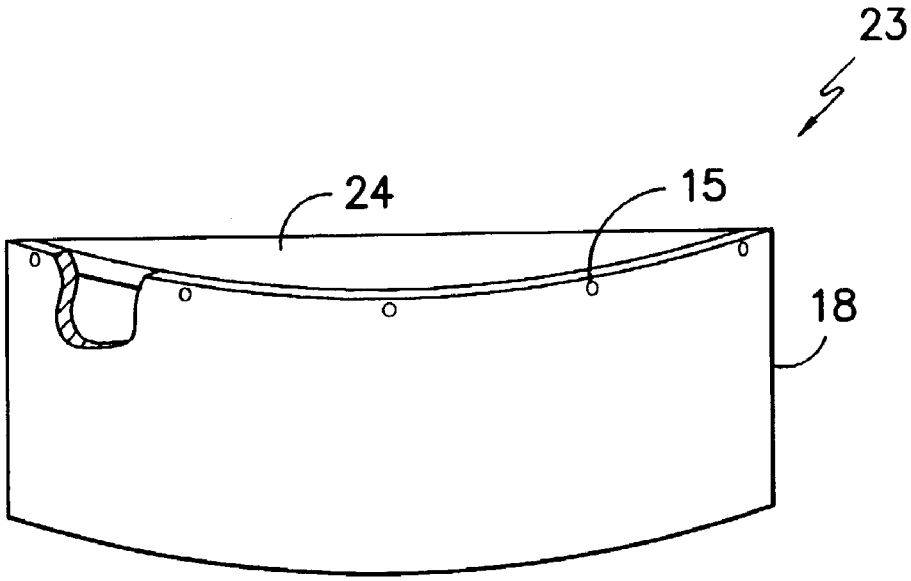
FIG. 7 is a perspective view of an exemplary corona treatment for disposition across a wall.

Another exemplary construction in the form of a so called "corona treatment" 23 is illustrated in FIG. 7. As will be appreciated, a corona treatment is typically mounted on a wall either at or below the ceiling line. According to the construction illustrated, the corona treatment 23 includes a top board 24 of arcuate geometry formed from felted fibrous material and a face panel 18 formed from felted fibrous material affixed in bowed mating relating around the top board 24 by fastening elements 15 such as nails, screws, adhesive and the like. As will be recognized, in such a construction, the flexible character of the felted fibrous material forming the face panel 18 facilitates proper bending of the face panel 18 during attachment to the top board 24. Of course it is contemplated that a decorative covering fabric may be glued, stapled or otherwise attached to the outer surface of the corona treatment 23.

Figure 8:
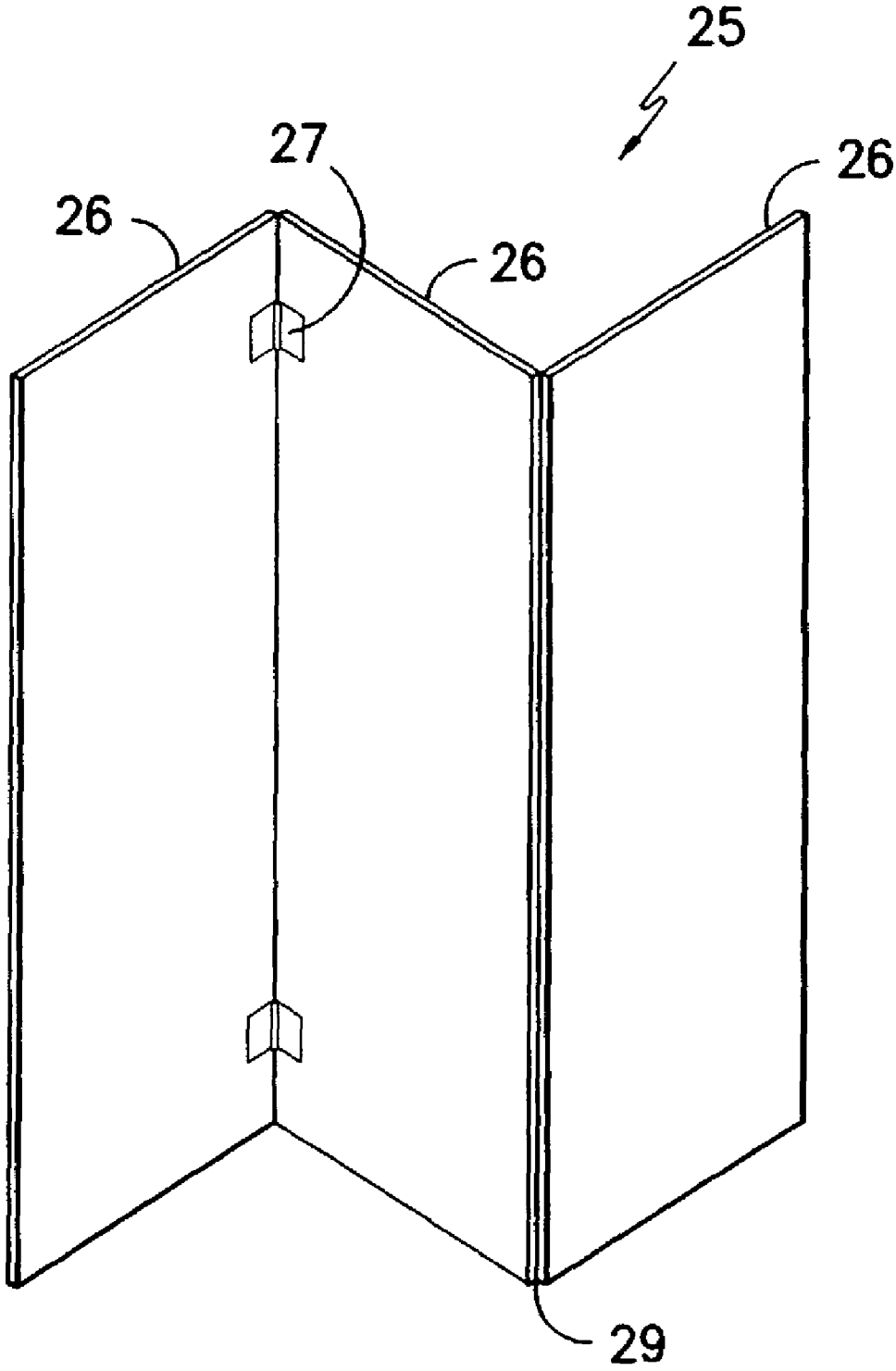
FIG. 8 is a perspective view of a screen.

The stability of the felted fibrous material utilized in accordance with the present invention has also been found to be adequate to form self supporting structures in the form of light weight furniture. By way of example, in FIG. 8, there is illustrated an exemplary decorative screen 25 including an arrangement of panels 26 of felted fibrous material and intermediate hinging elements 27 disposed between the panels 26. If desired, it is contemplated that living hinges 29 may be used between adjacent panels 26 in place of the intermediate hinging elements 27. In practice, such living hinges may be formed by scoring the felted fibrous material to a controlled depth. The material remaining at the base of the score line is sufficiently flexible relative to the surrounding material to permit localized bending thereby defining an integral living hinge. As with other described structures, it is contemplated that a decorative fabric may be affixed across the surface of panels 26 by gluing stapling or the like.

Figure 9:
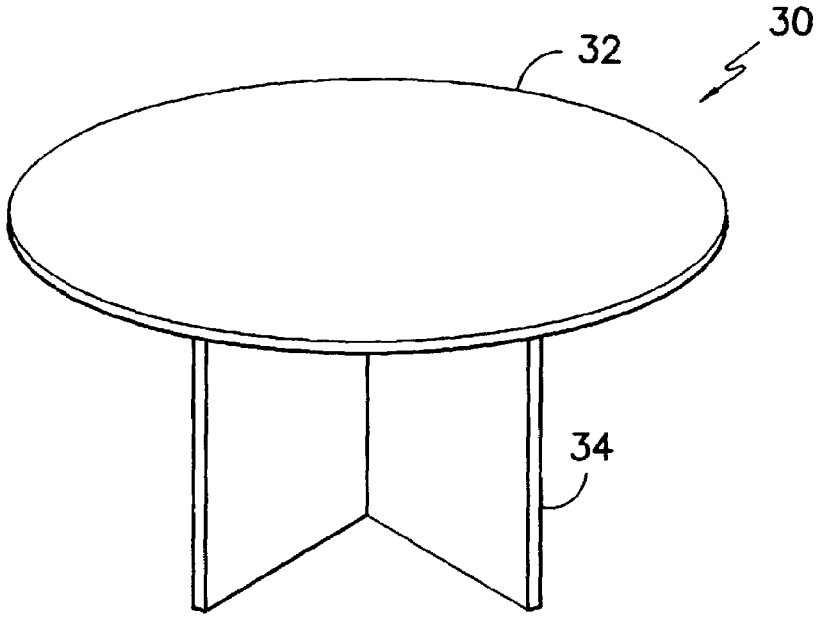
FIGS. 9 and 9A illustrate a table assembled from felted materials in accordance with the present invention.
Figure 9A:
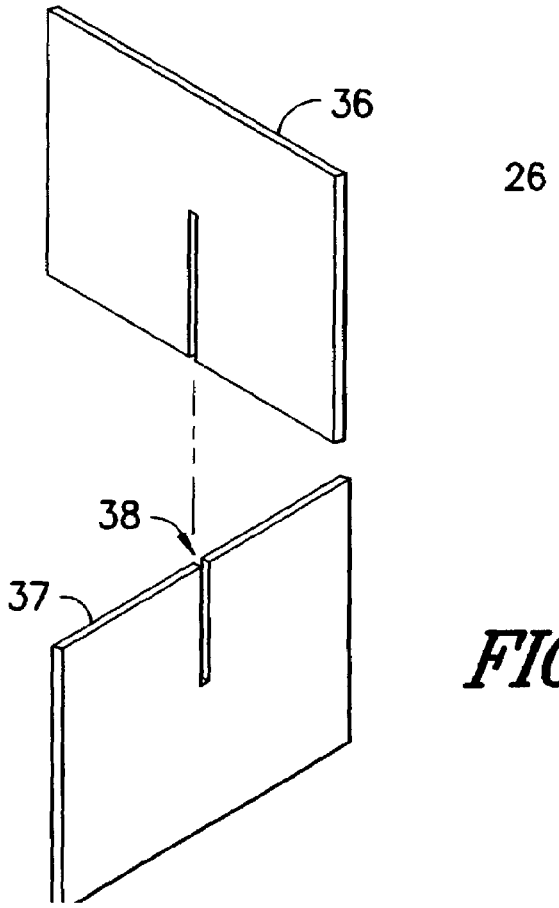

Aside from screens, other furniture structures are also contemplated. By way of example only, and not limitation, in FIGS. 9 and 9*a*, a table 30 is illustrated which may be formed from felted fibrous materials in accordance with the present invention. As shown, the table 30 includes a planar upper surface 32 which may be formed as a single piece or multi-piece cut-out from a panel of felted fibrous material. The table 34 also includes a base portion 34 disposed in supporting relation below the upper surface 32. The base portion 34 may likewise be formed from an arrangement of interlocking flat panels 36, 37 of felted fibrous material. As shown in FIG. 9A, The flat panels 36, 37 may be interlocked along a cooperating slot arrangement 38 to provide a free standing base geometry as illustrated in FIG. 9. Of course, the upper surface 32 and/or the base portion may be covered with a decorative fabric if desired.

As will be appreciated, the felted material forming the structures as previously described must have sufficient dimensional stability to permit the various components to be joined to one another and thereafter used in a structural capacity. Surprisingly, it has been found that fibrous felted materials such as needlepunched felts may be constructed to provide these requisite strength characteristics. In addition, these felted materials may be constructed to retain a controlled degree of flexibility which is useful in the construction and use of the finished articles for different environments.

Figure 10:
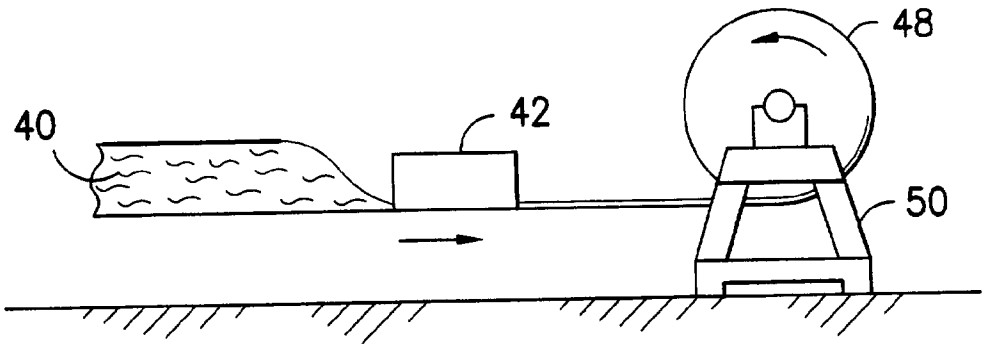
FIGS. 10 and 11 illustrate an exemplary practice for formation of felted construction material adapted for use in the interior design articles of the present invention.
Figure 11:
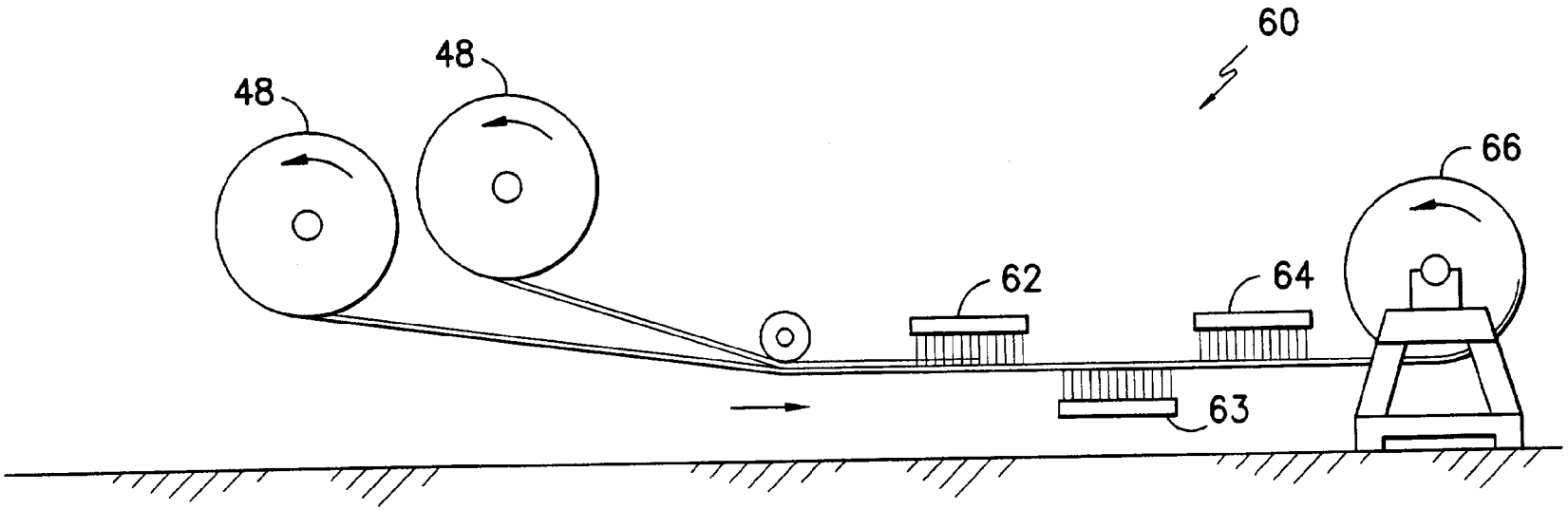
Figure 12:
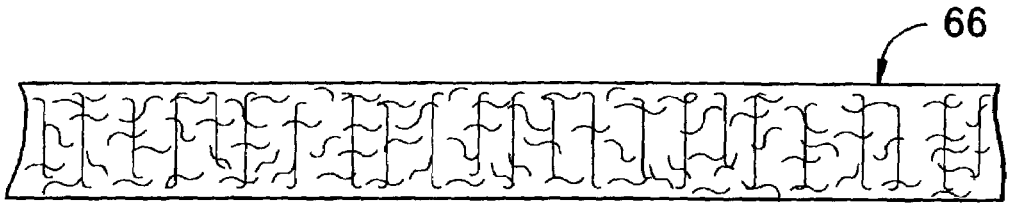
FIG. 12 is a schematic illustration of the felted construction material formed by the practice illustrated in FIGS. 10 and 11.

One exemplary practice for the production of a fibrous felted material suitable for formation into dimensionally stable decorative interior design components as previously described is illustrated schematically in FIGS. 10 and 11. According to the illustrated practice, a blend of discrete length staple fibers 40 is passed through a carding unit 42 to yield a carded web material 48 which is taken up on an "A" frame 50 or other collection device. The carded web material 48 is preferably a relatively light weight material having sufficient internal coherency to undergo further processing.

The blend of fibers 40 preferably includes some percentage of a relatively low melting point constituent so as to permit the heat activated point bonding of fibers to one another at later processing stages. According to one contemplated practice, the blend of fibers 40 is made up of substantially entirely of polyester with about 30 percent to about 90 percent (preferably about 70 percent) of the fibers 40 being a standard PET polyester staple fiber. By way of example only, one standard PET polyester staple fiber which is believed to be suitable is characterized by an average length of about 3 inches and a denier per filament rating of about 6 dpf. However, other staple fibers may likewise be utilized if desired. According to this practice about 10 percent to about 70 percent (preferably about 30 percent) of the fibers 40 are bi-component polyester fibers incorporating a sheath of low melting point CO-PET polyester around a standard PET polyester core. The core/sheath bicomponent polyester fiber prefereably has a denier per filament rating of about 2.5 to about 5.5 dpf. One such core/sheath fiber construction is believed to be available from Hoechst Celanese Corporation having a place of business in Salisbury, N.C., USA. As will be appreciated, upon the application of heat, the sheath material undergoes preferential flow and bonding to surrounding fiber constituents. Of course, other forms of low melting point material such as discrete fibers of low melting point material may also be utilized. Likewise, at least some percentage of the fibers 40 may be materials other than polyester. By way of example, it is contemplated that such materials may include nylon, polypropylene and the like.

As illustrated in FIG. 11, following formation of the rolls of carded web material 48, according to a potentially preferred practice of the invention a plurality of such rolls of carded web material 48 may thereafter be conveyed through a combining and densification station 60. At the combining and densification station 60, the carded web material 48 is conveyed in layered orientation through a series of needle looms 62, 63, 64 to combine the layers of carded web material into a cohesive structure. According to one practice, the first needle loom 62 utilizes about fifty-two needles per inch in the machine direction in a thirty-two gauge regular barb spacing arrangement. The second needle loom 63 preferably has a greater needle density than the first needle loom 62. By way of example only, in one contemplated practice the second needle loom 62 utilizes one hundred twenty five needles per inch in the machine direction in a thirty-six gauge regular barb spacing arrangement. The third needle loom 64 preferably utilizes about fifty-two needles per inch in the machine direction in a thirty-six gauge regular barb spacing arrangement.

In one contemplated practice, needles in each of the needle looms 62, 63, 64 are generally triangular in shape with nine barbs per needle although other needle arrangements and designs may likewise be utilized if desired. The resultant product leaving the combining and densification station 60 is an enhanced density batting material 66. According to one potentially preferred practice, the enhanced density batting has a thickness in the range of about 0.45 to about 0.5 inches with a mass per unit area in the range of about 48.3 to about 51.2 ounces per square yard. Of course, it is to be understood that this enhanced density batting material 66 is exemplary only and that greater or lower thicknesses and/or different densities may likewise be utilized. In one contemplated practice, this enhanced density batting material is conveyed as a single layer to a heating press for compression and heat activation of the low melting point fiber constituents in a manner as will be described further hereinafter.

Figure 15:
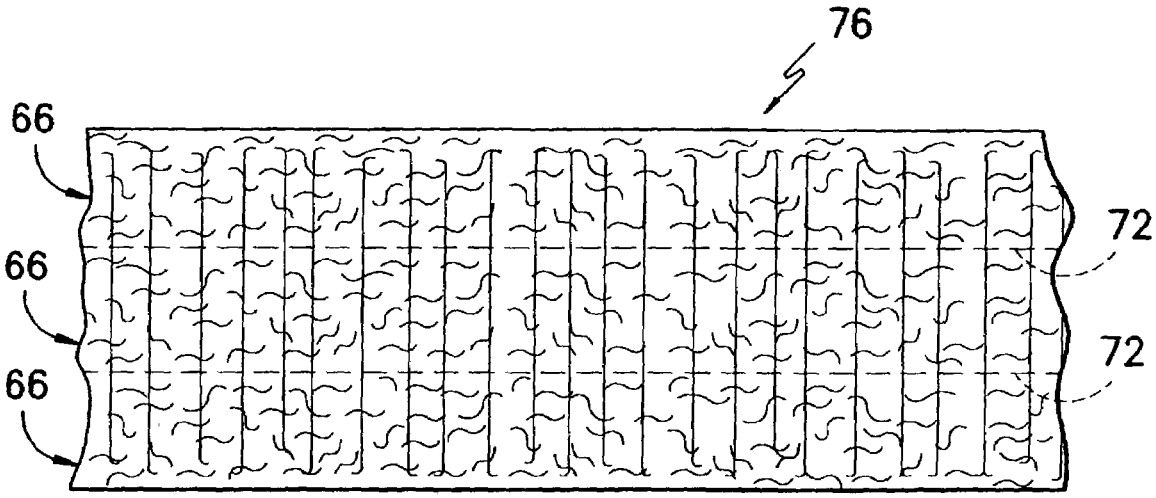
FIG. 15 is a schematic illustration of the multi-layer felted construction material formed by the exemplary practice illustrated in FIG. 13.
Figure 13:
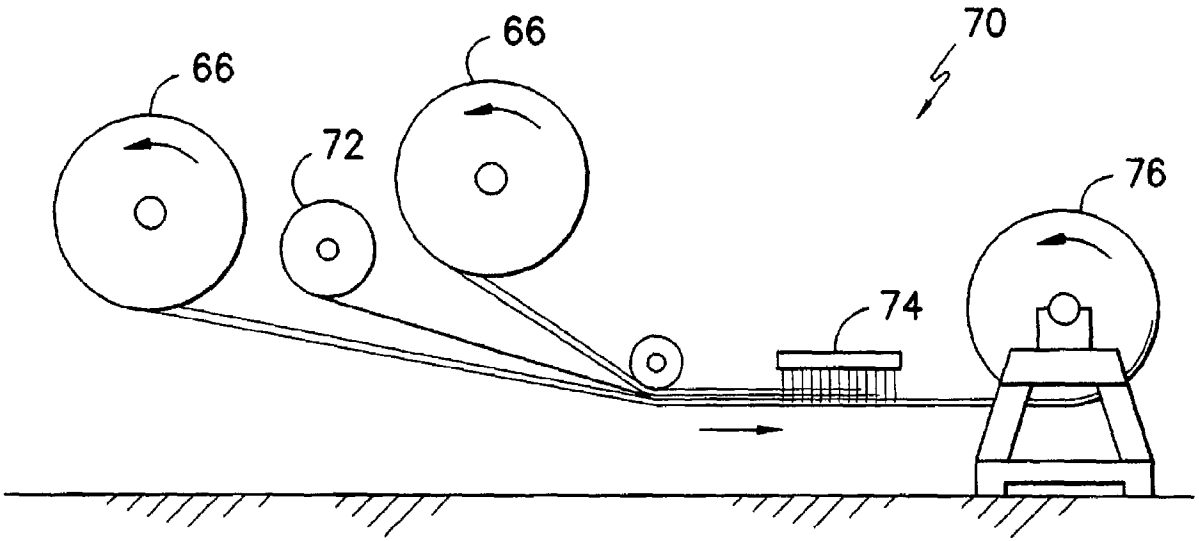
FIG. 13 illustrates an exemplary practice for formation of a multi-layer felted construction material adapted for use in the interior design articles of the present invention.

In the event that substantial thickness is desired in the article to be formed, it is contemplated that following formation of the enhanced density batting material 66, a plurality of rolls of such enhanced density batting material 66 may be conveyed to a laminate formation station 70 as illustrated schematically in FIG. 13. At the laminate formation station, the enhanced density batting material 66 is preferably conveyed in overlying and underlying relation to an intermediate layer of adhesive material 72 thereby forming a multi-layer sandwich structure 76 in which the adhesive material 72 is disposed between layers of enhanced density batting material 66. As will be appreciated, while the schematic processing line illustrated in FIG. 13 incorporates only two layers of enhanced density batting material 66, a larger number of layers of enhanced batting material 66 may likewise be used to form a sandwich structure with three or more layers as illustrated in FIG. 15.

According to the practice illustrated in FIG. 13, the juxtaposed layers of adhesive material 72 and enhanced batting material 66 are conveyed through an entangling needle loom 74 which serves to mechanically intermingle a portion of the fibers 40 from one or more layers of enhanced density batting material 66 with the adhesive material 72 and with the adjacent layer of batting or other material as may be incorporated within the sandwich structure 76 thereby mechanically binding fibers from the adjacent layers of the sandwich structure 76 together and increasing overall strength. Such a mechanical joining operation preferably results in a portion of the fibers 40 extending substantially across the boundary between two or more layers of the layered sandwich structure 76.

While the adhesive material 72 may be any wet or dry adhesive as may be suitable to bind the adjacent layers of felted material together, it is contemplated that the adhesive material 72 will preferably be a dry adhesive in web form so as to promote ease of use of the adhesive in roll form and to further permit the relatively easy mechanical entangling to be carried out across the adhesive by the needle loom 74. The adhesive material is preferably of a nature such that it can be activated upon demand through application of a predetermined driving force such as heat, hot gas, chemical interaction, ultrasonic energy, radio frequency radiation waves and the like. Further, it is contemplated that the adhesive should provide necessary resistance to heat, humidity and chemical interaction so as to avoid any premature delamination. One such heat activated adhesive fabric is believed to be available under the trade designation SPUNFAB® adhesive fabric from Dry Adhesive Technologies Inc. having a place of business at Cuyahoga Falls, Ohio, USA. According to a potentially preferred embodiment, the adhesive is SPUNFAB® type PA 1001 polyamide spunbonded adhesive fabric. However, other such adhesive fabrics of polyester, polyolefin, and ternary systems are also contemplated.

Figure 14:
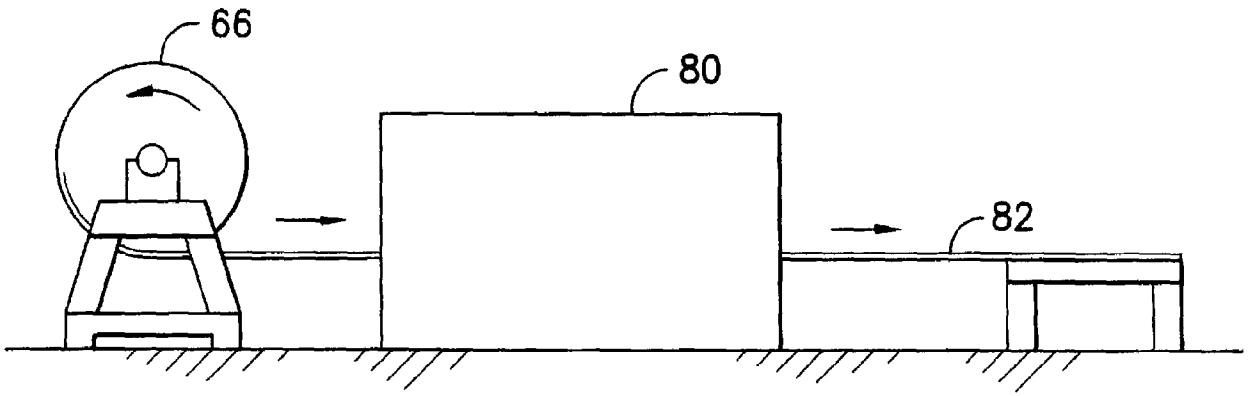
FIG. 14 illustrates schematically the heat fusion of felted construction material adapted for use in the formation of interior design articles and furniture.

Regardless of whether a single layer structure or multi-layer structure is desired, it is contemplated that either a single layer of the enhanced density batting material 66 or the multi-layer sandwich structure 76 as previously described will preferably be conveyed through a hot press 80 (FIG. 14) to activate the low melting point fiber constituent as well as any heat activated adhesive layers. According to one contemplated practice, the enhanced density batting material 66 or the multi-layer sandwich structure 76 is heated to a temperature of approximately 340 degrees Fahrenheit for a period sufficient to activate the low melting point fiber constituent. By way of example only, for a single layer structure having a starting thickness of about 0.5 inches, the period of heating will normally be about 6 minutes. The application of heat and pressure causes the low melting point material forming the sheath of the bicomponent fiber constituent to flow and form fusion bonding points with adjacent fibers once cooling takes place. The resultant heat fused felted fiber material 82 in either single layer or multi-layer form is preferably characterized by a thickness in the range of about 0.04 inches to about 2 inches with a mass per unit area in the range of about 6 ounces per square yard to about 400 ounces per square yard and a density of about 0.065 ounces per cubic inch to about 0.210 ounces per cubic inch. By way of example only, one heat fused compressed construction which is believed to be particularly versatile is a single layer construction having a thickness in the range of about 0.394 inches to about 0.480 inches (most preferably about 0.437 inches) with a mass per unit area of about 90 ounces per square yard to about 110 ounces per square yard (most preferably about 100 ounces per square yard). Multiple layer constructions may have similar densities although the mass per unit area may be greater. Of course, other density levels may likewise be utilized if desired.

The felted fiber material 82 is sufficiently stiff to be cut into board stock for subsequent formation into various interior decorative articles and furniture as previously described. However, due to the felted nature of the material and the fact that stiffness is imparted by a distribution of fusion bonding points between fibers, the material nonetheless retains a degree of flexibility permitting relatively easy bending manipulation. In this regard it is contemplated that stiffness may be adjusted as desired by adjusting the percentage of low melting point material in the fiber blend. In particular, it is contemplated that increasing the percentage of bicomponent fiber will result in increased stiffness due to the occurrence of a greater concentration of fusion bonding points. Likewise, reducing the percentage of bicomponent fiber will result in reduced stiffness due to the lower concentration of fusion bonding points. As previously indicated, the fiber blend preferably contains in the range of about 10 percent to about 70 percent bicomponent fibers.

As indicated, it is contemplated that the felted fiber material 82 used in forming the decorative articles and furniture according to the present invention may be useful over a wide range of thicknesses ranging from about 0.04 inches to about 2 inches. In this regard it is to be noted that if the panel is to have a thickness substantially greater than about ½ inch, the use of a multi-layer construction with an intermediate adhesive layer may be desirable.

It is to be understood that while the present invention has been illustrated and described in relation to potentially preferred embodiments, constructions, and procedures, such embodiments, constructions, and procedures are illustrative only and that the present invention is in no event to be limited thereto. Rather, it is contemplated that modifications and variations embodying the principles of the present invention will no doubt occur to those of ordinary skill in the art. It is therefore contemplated and intended that the present invention shall extend to all such modifications and variations as may incorporate the broad aspects of the present invention within the true scope and spirit thereof.

The invention claimed is:

1. A bed headboard comprising a structural body panel defining the interior and perimeter profile of the headboard, wherein said structural body panel consists essentially of a panel of stiff fibrous board stock material, of substantially constant thickness and wherein said stiff fibrous board stock material consists essentially of one or more layers of fibrous felted material of needlepunched construction, said fibrous felted material comprising a plurality of entangled polymeric fibers and wherein at least a portion of said entangled polymeric fibers are melt fused together such that a plurality of fiber to fiber fusion bonding points are distributed within said fibrous felted material.

2. The invention as recited in claim 1, wherein said headboard further comprises a pair of supporting mounting posts of said fibrous felted material.

3. The invention as recited in claim 1, wherein said fibrous felted material consists essentially of a blend of entangled polyester fibers.

4. The invention as recited in claim 3, wherein the blend of entangled polyester fibers includes a first portion of polyester fibers characterized by a first melting point and at least a second portion of polyester fibers comprising a low melting point polyester constituent characterized by a second melting point which is lower than the first melting point.

5. The invention as recited in claim 4, wherein at least a percentage of said second portion of polyester fibers comprise a sheath of said low melting point polyester constituent disposed in surrounding relation to a core of polyester having a melting point greater than the low melting point polyester constituent.

6. The invention as recited in claim 4, wherein the low melting point polyester constituent is characterized by a melting point of less than about 340 degrees Fahrenheit.

7. The invention as recited in claim 1, wherein the fibrous felted material is characterized by a thickness in the range of about 0.04 to about 2 inches and a density in the range of about 0.065 to about 0.21 ounces per cubic inch.

8. The invention as recited in claim 1, wherein said fibrous felted material consists essentially of a blend of entangled polyester fibers, and wherein about 10% to about 40% of the entangled polyester fibers are bicomponent fibers comprising a core of a first polyester constituent characterized by a first melting point and a sheath of a second polyester constituent characterized by a second melting point which is lower than the first melting point.

9. A bed headboard comprising a structural body panel defining the interior and perimeter profile of the headboard, the structural body panel consisting essentially of a panel of stiff fibrous board stock material, of substantially constant thickness wherein said stiff fibrous board stock material consists essentially of a single layer of fibrous felted material of needlepunched construction, said fibrous felted material comprising a plurality of entangled polymeric fibers, wherein at least a portion of said entangled polymeric fibers are melt fused together such that a plurality of fiber to fiber fusion bonding points are distributed within said fibrous felted material.

10. The invention as recited in claim 9, wherein said fibrous felted material consists essentially of a blend of entangled polyester fibers.

11. The invention as recited in claim 10, wherein the blend of entangled polyester fibers includes a first portion of polyester fibers characterized by a first melting point and at least a second portion of polyester fibers comprising a low melting point polyester constituent characterized by a second melting point which is lower than the first melting point.

12. The invention as recited in claim 11, wherein at least a percentage of said second portion of polyester fibers comprise a sheath of said low melting point polyester constituent disposed in surrounding relation to a core of polyester having a melting point greater than the low melting point polyester constituent.

13. The invention as recited in claim 9, wherein said fibrous felted material consists essentially of a blend of entangled polyester fibers, and wherein about 10% to about 40% of the entangled polyester fibers are bicoinponent fibers comprising a core of a first polyester constituent characterized by a first melting point and a sheath of a second polyester constituent characterized by a second melting point which is lower than the first melting point.

14. A bed headboard comprising a structural body panel defining the interior and perimeter profile of the headboard, the structural body panel consisting essentially of stiff fibrous board stock material, of substantially constant thickness wherein said stiff fibrous board stock material consists essentially of a plurality of layers of fibrous felted material of needlepunched construction disposed in adjacent stacked relation with adhesive disposed between at least a portion of said layers of fibrous felted material of needlepunched construction such that adhesive extends in contacting adjoining relation between adjacent layers of said fibrous felted material of needlepunched construction, said fibrous felted material of needlepunched construction comprising a plurality of entangled polymeric fibers and wherein at least a portion of said entangled polymeric fibers are melt fused together such that a plurality of fiber to fiber fusion bonding points are distributed within said fibrous felted material of needlepunched construction.

15. The invention as recited in claim 14, wherein said fibrous felted material consists essentially of a blend of entangled polyester fibers.

16. The invention as recited in claim 15, wherein the blend of entangled polyester fibers includes a first portion of polyester fibers characterized by a first melting point and at least a second portion of polyester fibers comprising a low melting point polyester constituent characterized by a second melting point which is lower than the first melting point.

17. The invention as recited in claim 16, wherein at least a percentage of said second portion of polyester fibers comprise a sheath of said low melting point polyester constituent disposed in surrounding relation to a core of polyester having a melting point greater than the low melting point polyester constituent.

18. The invention as recited in claim 14, wherein said fibrous felted material consists essentially of a blend of entangled polyester fibers, and wherein about 10% to about 40% of the entangled polyester fibers are bicomponent fibers comprising a core of a first polyester constituent characterized by a first melting point and a sheath of a second polyester constituent characterized by a second melting point which is lower than the first melting point.

* * * * *